United States Patent [19]

Dolan et al.

[11] Patent Number: 4,992,195

[45] Date of Patent: Feb. 12, 1991

[54] DISHWASHING COMPOSITION

[75] Inventors: Michael J. Dolan, Manchester; Frank P. Jakse, Florissant, both of Mo.

[73] Assignee: Monsanto Company, St. Louis, Mo.

[21] Appl. No.: 231,325

[22] Filed: Aug. 10, 1988

[51] Int. Cl.[5] ..... C11D 17/04; D06M 13/46

[52] U.S. Cl. ..... 252/99; 252/95; 252/105; 252/186.25; 252/187.25; 252/187.26

[58] Field of Search ..... 252/95, 99, 105, 186.25, 252/187.25, 187.26

[56] References Cited

U.S. PATENT DOCUMENTS 3,583,922 6/1971 McClain et al. ..... 252/99

*Primary Examiner*—Paul Lieberman
*Assistant Examiner*—John F. McNally
*Attorney, Agent, or Firm*—Raymond C. Loyer

[57] ABSTRACT

There is disclosed stable aqueous slurry automatic dishwasher detergent compositions comprising a chlorine bleaching agent and a dual function bleach stabilizer and anticorrosion agent comprising sulfamic acid, or its water soluble salts. Such formulations containing a molar ratio of at least about 0.5:1 sulfamic acid/bleaching agent provides protection against corrosion of silver metal and stabilizes bleach in the detergent composition.

21 Claims, No Drawings

DISHWASHING COMPOSITION

This invention relates to detergent compositions containing bleaching agents in an aqueous slurry automatic dishwasher detergent composition and particularly to such compositions which are rendered noncorrosive to silverware and more stable by incorporation of sulfamic acid, or its water soluble salts.

BACKGROUND OF THE INVENTION

Detergent compositions for use in automatic dishwashing equipment have long contained a bleaching agent to operate in the relatively severe conditions of such equipment. High temperatures conditions and highly alkaline solutions of detergent materials effectively clean dishes and silverware by hydraulic action. In such systems bleach concentrations as well as detergent concentrations can be tolerated at higher levels than those levels employed with hand washing operations for obvious reasons. There has long been prepared granular or powder compositions designed for automatic dishwasher use conveniently placed in the compartment of the automatic dishwasher and released at the appropriate time by the mechanism of the mechanical dishwasher. However, modern marketing trends has shown that it is becoming more desirable to prepare liquid compositions rather then powder compositions for use in such apparatus. Therefore, stable formulations in liquid form such as slurries are being sought which can safely and conveniently be employed in place of previously employed powder compositions.

Liquid automatic dishwasher cleaning compositions present new problems and increased potential for consequences of misuse not previously encountered with powder compositions. For example, the bleaching agent in powder compositions spilled upon textile material can easily be removed without damage provided no liquid is available for the bleaching agent to become activated. Simple brushing will provide removal of the detergent composition containing the bleaching agent without serious danger of dye damage resulting from the bleach which is present, as previously noted, in relatively high concentration. However, should a slurry composition be misused or spilled upon textile material, it will immediately allow bleach activity and severe dye damage to occur, not allowing an opportunity for removal before such damage occurs.

Liquid detergent formulations for automatic dishwasher use has exacerbated another problem known in the art and previously controlled. Such problem is metal corrosion. Previously, metal corrosion has been effectively dealt with by incorporating a metal corrosion inhibitor in the composition, such inhibitors being generally sodium silicate or clays. Sodium silicate use as a metal corrosion inhibitor was known as for example in U.S. Pat. No. 3,468,803 to Knapp et al which discloses powder formulations useful in automatic dishwasher apparatus. Knapp et al recognize that metal corrosion inhibition satisfactory for protection of metal portions of the dishwashing apparatus was obtained by such corrosion inhibitors as sodium silicate but in liquid formulations such material is inadequate, particularly for inhibition of corrosion of precious metals such as silver. Knapp et al teach that silver corrosion inhibition is achieved by incorporation of cyanuric acid or a salt thereof in the liquid formulation. Also, German published application DE3,325,503A discloses liquid or thixotropic detergent formulations for automatic dishwasher apparatus wherein sodium silicate is employed to inhibit corrosion of metals and to protect china.

The incorporation of a bleaching agent in liquid formulations for automatic dishwasher use greatly increases the risk of damage because of the concentrated form which these formulations must take. Initial entry into the dishwasher apparatus of the liquid formulation can damage metal quickly before dilution occurs. Even in diluted form corrosion of metals such as silver remains a problem for liquid detergent formulations for automatic dishwashers.

In spite of the dangers of spillage and other misuse, consumers have perceived that liquid automatic dishwasher liquids are more desirable powder formulations because of their ease in handling and recognized quicker dissolution in the automatic dishwasher. Most consumers have witnessed powders in automatic dishwashers that leave a gritty residue or are found in a solid lump which did not dissolve well during the wash cycle. There is therefore desired an automatic dishwasher liquid detergent formulation which overcomes the above noted deficiencies.

Summary of the Invention

According to this invention there are provided aqueous slurry automatic dishwasher compositions which comprise sulfamic acid or its water soluble salts and a hypohalite bleach forming agent together with a builder and other materials normally included in such compositions designed to be employed in automatic dishwasher equipment. The novel compositions of this invention are in the form of slurries containing at least about 50% water, sulfamic acid or a water soluble salt thereof and a hypohalite bleach forming agent wherein the molar ratio of sulfamic acid or salt thereof to bleaching agent is at least about 0.5:1.

Detailed Description of the Invention

The automatic dishwasher liquids of this invention containing sulfamic acid or a water soluble salt thereof have been surprisingly found to be inhibited as to dye damage and corrosion of silver. Further, hypohalite bleaching agents commonly employed in ADLs are stabilized by sulfamic acid or its water soluble salts thereby rendering compositions of this invention more effective as well as safer and more versatile than previous ADLs. The advantage of chlorine stabilization is particularly seen in compositions of this invention containing no surfactant. While it is entirely feasible to employ the acid in compositions of this invention, typical salts thereof may also be employed Sulfamic acid as used herein also includes water soluble sulfamics which give the sulfamic ion in solution Especially preferred sulfamics include sodium and potassium salts of sulfamic acid. Other water soluble sulfamics include magnesium, calcium, lithium, and aluminum salts. Sulfamic acid itself is preferred since it is easily handable and can be employed in commercial scale operations. Sodium and potassium sulfamics are also preferred because of their ease of handling and availability. Although some sulfamics may be hygroscopic, their utility in preparing compositions of this invention are not reduced particularly because such compositions are liquid, thereby eliminating the concern for lumping or caking which is considered undesirable in preparing powdered or granular materials.

Suitable bleach compounds which provide the bleaching agent in compositions of this invention are those which produce available chlorine in actual washing conditions. The bleach component can be any compound capable of liberating hypohalite such as hypochlorite and/or hypobromite on contact with aqueous media. Examples include the alkali metal hypochlorites or hypobromites or alkaline earth metal hypochlorites or hypobromites. Examples of such useful bleaches are sodium hypochlorite, potassium hypochlorite, lithium hypochlorite, calcium hypochlorite and magnesium hypochlorite. Sodium hypochlorite is highly desirable because of its ready availability. However, lithium and magnesium hypochlorites are desirably stable. Although many of these bleaches are considered to be very strong bleaches because of the readily available chlorine, it has been found that sulfamic acid or its salts inhibit silver metal corrosion of even these strong bleaches.

Beneficial effects of the sulfamics of this invention are indicated at a molar ratio of sulfamic to hypohalite bleaching agent of 0.5 to 1. Preferably the ADLs of this invention contain molar ratios of sulfamics to hypohalite bleach in the range of from 1:1 to 3:1. Higher ratios of sulfamics to bleaching agent may be employed but any additional benefit does not warrant the additional material.

An important part of detergent compositions are builders which are employed to sequester metal ions in solution Such builders include any of the builders previously known to prepare slurried detergents. Polyphosphates are the preferred builders employed in compositions of this invention as they act as a water softener with great efficiency. Polyphosphates commercially available having a $Na_2O$ or $K_2O$ to $P_2O_5$ ratio about 1:1 to 2:1 are typically employed Polyphosphates of this kind are sodium tripolyphosphate, sodium hexametaphosphate and sodium pyrophosphate as well as the corresponding potassium salts.

Other types of builders useful in compositions of this invention may be employed such as the known polycarboxylates all of which are well known in the art as builder compositions useful to provide water softening function.

Within the scope of ADLs of this invention are thixotropic formulations which exhibit, upon shear force, the properties of liquids Such compositions are described in the above-mentioned publication DE 3,325,503A which is hereby incorporated by reference. Additives such as clays or polyacrylates are described therein which provide thixotropy and such additive are useful in the ADL of the present invention.

Surfactant may be employed in compositions of this invention typically in the range of from 0 to about 5 percent by weight. Foam suppressants are desirable in the event the surfactant causes foaming. Suitable surfactants are those compatible with the other essential components of the ADL's of this invention. Preferred surfactants include alkylaryl sulfonates and more particularly alkyl benzene sulfonates. The alkyl benzene sulfonates preferably contain alkyl groups containing from 8 to 20 carbon atoms and more preferably from 10 to 12 carbon atoms.

Other suitable surfactants are amine oxides of the general formula $R_2R'NO$, wherein each R group is a lower alkyl group, e.g. methyl, while R' is a longchain alkyl group with 8 to 22 carbon atoms, e.g. a lauryl, myristyl, palmityl, or cetyl group. Instead of an amine oxide, one can also use a corresponding phosphine oxide of the general formula $R_2R'PO$ or a sulfoxide RR'SO. The surfactants of the betaine type have the general formula $R_2R'N^+R''CO^-$, while each R means a low alkylene group with one to five carbon atoms. Suitable examples for these surfactants are lauryldimethylamine oxide, myristyldimethylamine oxide, cocodimethylamine oxide, hydrogenated tallowdimethylamine oxide as well as the corresponding phosphine oxides and sulfoxides and the corresponding betaines including dodecyldimethylammonium-acetate, tetradecyldiethylammonium-pentanoate, hexadecyldimethylammonium-hexanoate and so on. With regard to the biological degradability, the alkyl groups in these surfactants should be linear, these are therefore preferred.

Surfactants of this type are generally known and are described, for example, in U.S. Pat. Nos. 3,985,668 and 4,271,030. Other surfactants include organic anionic products, amine oxides, phosphine oxides, sulfoxides, and betaines as water-dispersible surfactant types, linear or branched alkali metal mono- and/or di-$C_8$-$C_{14}$-alkyldiphenyl oxide monosulfonates and/or disulfonates, for example, the commercially available products DOWFAX 3B-8 and DOWFAX 2A-1.

Low foaming formulations are preferred. The polyethenoxy nonionics are widely used for this purpose and the polymeric nonionics such as the Pluronic series are particularly preferred.

Sodium silicate which contributes to the alkalinity and to the protection of hard surfaces, such as porcelain glaze and design is used in a quantity in the range from about 2.5 to 20% by weight, preferably from about 5 to 15% by weight in the dishwasher detergent of the present invention. Sodium silicate is usually added in the form of an aqueous solution and preferably has a $Na_2O:SiO_2$ ratio of about 1:2.2 to 1:2.8. Likewise, most other components of the dishwasher detergent of the present invention, particularly sodium hydroxide, sodium hypochlorite, foam suppressor, and thixotropic thickening agent are frequently used in the form of previously prepared aqueous dispersions or solutions.

Other ingredients usually employed include dye, pigments, perfumes, antibacterial agents, abrasives and other additives believed useful in enhancing the cleaning capability of such compositions.

Typical compositions of this invention comprise, by functional category, the following ingredients by approximate weight percent:

| | WT % |
|---|---|
| Detergent Builder | 10–35 |
| Surfactant | 0–5 |
| Bleaching Agent (NaOCl equiv) | .3–3 |
| Sulfamic Acid (acid equiv) | 2–7 |
| Stabilizer Agent | 1–10 |
| Water | Q.S. |

The pH value of the ADL of this invention is preferably at least about 10.5 and more preferably in the range of from about 11 to 13.5. Adjustment of pH with basic materials such as sodium hydroxide or other suitable bases will provide the preferred range of pH.

The invention will be more clearly understood by reference to the following examples wherein all percentages are by weight unless otherwise stated.

EXAMPLE 1

The influence of sulfamic acid on corrosion of metalic silver by a 1% solution of sodium hypochlorite was determined. In Table I below there is shown results of tests wherein sodium hypochlorite solutions containing various amounts of sulfamic acid were allowed to spot contact the finish of a silver spoon which was taken from commercially purchased silverplate tableware. After the noted contact time the silver was rinsed thoroughly with tap water and subjectively assessed for corrosion damage in comparison to adjacent non-contacted area. In Table I "molar ratio" indicates the molar ratio of sulfamic acid to sodium hypochlorite in solution. Contact time shown in Table I is expressed in seconds.

In the following Table I and in all of the following examples the subjective rating for silver corrosion is expressed by the following adjectives progressing from the least detectable corrosion by the unaided eye to the worst corrosion observed:

detectable
trace
mild
moderate
strong
severe

TABLE I

| Molar Ratio | Contact Time | Effect |
|---|---|---|
| 0:1 | 30 | Trace |
| | 60 | Mild |
| | 120 | Moderate |
| | 240 | Strong |
| | 480 | Severe |
| 1.2:1 | 120 | Detectable |
| | 960 | <Trace |
| 2:1 | 240 | Detectable |
| | 960 | <<Trace |
| 2.8:1 | 960 | Detectable |

EXAMPLE 2

The influence of various known bleach mitigators thiourea, melamine and trisodium imidodisulfonate (TSIS) on corrosion of metalic silver was determined by the procedure of Example 1. In this example, a base ADL formulation was employed into which the bleach mitigator was incorporated. Also employed in the test was a commercial ADL sold under the trade name Palmolive Liquid by the Colgate Palmolive Company. The noncommercial ADL formulation was as follows:

| Ingredient | Weight % |
|---|---|
| Sodium Carbonate | 5 |
| RU sodium silicate (47% solids) | 10 |
| Sodium tripolyphosphate | 20 |
| Sodium hypochlorite (~10–14% NaOCl) | 1.4 |
| Clay (Attagel 50) | 3 |
| Polyacrylate (Acrysol LMW-45) | 0.5 |
| Deionized water | balance |

The above formulation was prepared by dissolving sodium carbonate in 75% of the total deionized water employed Silicate was then added. Sodium tripolyphosphate was added solely with agitation and after all of the sodium tripolyphosphate was added the remaining water was added with stirring for about 1 hour to render a creamy, smooth, non-gritty slurry. The slurry was cooled in an ice bath to about 15° C. and sodium hypochlorite added slowly. Clay was then added as a thickener and the mixture stirred for about 15 minutes to complete hydration of the clay. The resulting ADL exhibited a pH of 13.3. Various known bleach mitigators as well as sulfamic acid were added to samples of the base formulation prepared as described above. Sulfamic acid was either predissolved with an equivalent amount of sodium hydroxide in water or added as a solid slowly with stirring.

The results of the tests appear in Table II below. Also included in Table II is data obtained from dye damage tests as "Dye Score". In the dye damage test swatches of cotton cloth dyed with immedial green dye is contacted with the ADL and then rinsed clean after the time lapse noted in the table. The "Dye Score" noted in the table is based upon the visual appearance of the treated swatch giving the value 0 to the untreated swatch and the value 10 to the swatch treated with base composition.

TABLE II

| MOLAR RATIO | % NaOCl | CONTACT TIME | SILVER ATTACH | DYE SCORE |
|---|---|---|---|---|
| BASE | 2.94 | 15 sec | moderate | 10 |
| | | 15 min | severe | |
| 3:1 TSIS | 2.71 | 15 sec | moderate | |
| | | 30 sec | — | 9 |
| | | 15 min | severe | |
| 0.1:1 sulfamic | 2.67 | 15 sec | light | |
| | | 30 sec | — | 10 |
| | | 15 min | moderate | |
| 1:1 sulfamic | 2.88 | 15 sec | none | |
| | | 30 sec | — | 2 |
| | | 15 min | none | |
| 3:1 sulfamic | 2.69 | 15 sec | none | |
| | | 30 sec | — | 0 |
| | | 15 min | none | |
| PALMOLIVE LQD | 1.48 | 15 sec | moderate | |
| | | 30 sec | — | 8 |
| | | 15 min | severe | |
| 1:1 sulfamic in PALMOLIVE LDQ | 1.40 | 15 sec | none | |
| | | 30 sec | — | 1 |
| | | 15 min | trace | |
| 1:1 thiourea | * | 15 sec | moderate | 1 |
| | | 60 sec | — | 2 |
| | | 15 min | moderate | |

*No active chlorine was detected by iodometric titration at the end of the test. (2 hours)

EXAMPLE 3

Storage stability of ADL formulations was determined by storing the above-described base formulation of Example 2 at room temperature in sealet glass jars together with samples of such formulation containing different molar ratios of sulfamic acid to sodium hypochlorite. Also tested was a formulation containing TSIS. The amount of available chlorine at various time intervals was measured in each sample and reported in Table III below as a ratio of the amount of chlorine available at the start of the test. As can be seen from the data in Table III below, sulfamic acid stabilizes chlorine in the ADL formulation while TSIS addition results in lower chlorine availability than the ADL formulation without a bleach mitigator.

As in Example 2 the pH exhibited by the ADLs tested in this example was 13.3. The composition noted in Table III below with respect to base ADL and the formulation containing sulfamic acid or TSIS are indicated as molar ratios of sulfamic acid or TSIS to bleaching agent.

TABLE III

| COMPOSITION | | | | | | | | | | | | | |
|---|---|---|---|---|---|---|---|---|---|---|---|---|---|
| Base | Days | 0 | 2 | 7 | 9 | 14 | 23 | 30 | 37 | 45 | 51 | 64 | 83 |
| | Total Cl | 1.41 | 1.38 | 1.37 | 1.36 | 1.35 | 1.30 | 1.26 | 1.22 | 1.10 | 1.18 | 1.11 | 1.03 |
| | Ratio | 1 | .98 | .97 | .96 | .96 | .92 | .89 | .87 | .78 | .84 | .79 | .73 |
| .1/1 sulfamic | Days | 0 | 2 | 7 | 9 | 14 | 16 | 23 | 30 | 38 | 45 | 57 | 76 |
| | Total Cl | 1.2 | 1.16 | 1.12 | 1.14 | 1.11 | 1.12 | 1.08 | 1.10 | 1.06 | 1.01 | .97 | .97 |
| | Ratio | 1 | .91 | .88 | .89 | .87 | .88 | .84 | .86 | .83 | .79 | .76 | .75 |
| 1:1 sulfamic | Days | 0 | 2 | 7 | 9 | 14 | 16 | 23 | 30 | 38 | 45 | 57 | 76 |
| | Total Cl | 1.38 | 1.38 | 1.37 | 1.35 | 1.38 | 1.36 | 1.38 | 1.36 | 1.36 | 1.36 | 1.36 | 1.35 |
| | Ratio | 1 | 1 | .99 | .98 | 1 | .99 | 1 | .99 | .99 | .99 | .99 | .98 |
| 3:1 sulfamic | Days | 0 | 2 | 7 | 9 | 14 | 23 | 30 | 45 | 52 | 64 | 83 | |
| | Total Cl | 1.29 | 1.29 | 1.28 | 1.27 | 1.28 | 1.29 | 1.29 | 1.27 | 1.27 | 1.28 | 1.26 | |
| | Ratio | 1 | 1 | .99 | .99 | .99 | 1 | 1 | .99 | .99 | .99 | .98 | |
| 3:1 TSIS | Days | 0 | 2 | 7 | 9 | 14 | 23 | 30 | 45 | 52 | 64 | 83 | |
| | Total Cl | 1.3 | 1.2 | 1.2 | 1.1 | 1.1 | 1.0 | 1.0 | .89 | .86 | .80 | .71 | |
| | Ratio | 1 | .94 | .91 | .89 | .85 | .80 | .77 | .69 | .66 | .62 | .55 | |

The data in the above Example 3 shows that sulfamic acid stabilizes the bleaching agent in an ADL over an extended time period whereas TSIS is ineffective in this regard.

EXAMPLE 4

The stability of active chlorine in commercial Palmolive Liquid detergent and its relationship to silver corrosion and dye damage was determined by taking four 50 g samples of the commercial product and cooling the samples to 15° C. with stirring. While at 15° C. various additives were combined with the sample as noted below. The amount of additive in shown in Table IV below as the mole ratio of additive to bleaching agent. The additives were first dissolved in 5 g of a 2% by weight sodium hydroxide solution. After thorough mixing portions of the samples were employed in the silver corrosion and dye damage tests described above. Such tests were conducted within a two hour period after formulation of the sample. In addition, the amount of active chlorine was determined within 2 hours after formulation and again after 21 hours during which time the samples were stored in plastic containers at room temperature or at about 23° C. The silver corrosion and dye damage tests were performed as described above. The data for active chlorine in Table IV is presented as the percent of theoretical total amount. It is noted that experimental error will provide measurements in excess of 100%. The data obtained for the amount of active chlorine is presented in Table IV below and the data obtained with respect to silver and dye damages are presented in Table V.

TABLE IV

| ADDITIVE | AMOUNT | ACTIVE CHLORINE 2 hrs | ACTIVE CHLORINE 21 hrs |
|---|---|---|---|
| (A) sulfamic acid | 1.00 | 104.0 | 98.0 |
| (B) cyanuric acid | 1.75 | 98.2 | 48.0 |
| (C) thiourea | 0.80 | 0 | — |
| (D) control | | 100.0 | 96.8 |

TABLE V

| Time Min. | Sample A Silver Dye | Sample B Silver Dye | Sample D Silver Dye |
|---|---|---|---|
| 1 | none none | mild moderate | mild strong |
| 2 | trace none | mild severe | moderate- |
| 4 | mild none | mild severe | strong- |

We claim:

1. An aqueous slurry automatic dishwashing composition comprising a hypohalite bleach forming agent selected from the group consisting of alkali metal and alkaline earth metal hypohalites in aqueous solution, sulfamic acid or a water soluble salt thereof, a stabilizing agent and a detergent builder wherein the molar ratio of sulfamic acid or equivalent to said bleach forming agent is 1:1 to 3:1.

2. A composition of claim 1 further including a bleach stable surfactant.

3. A composition of claim 2 wherein the surfactant is an alkyl benzene sulfonate.

4. A composition of claim 3 wherein the alkyl group contains from about 8 to 20 carbon atoms.

5. A composition of claim 4 wherein the ratio of sulfamic acid or equivalent to bleach forming agent is in the range of from about 1 to 1 to about 3 to 1.

6. A composition of claim 1 wherein the detergent builder is sodium tripolyphosphate.

7. A composition of claim 4 wherein the detergent builder is sodium tripolyphosphate.

8. A composition of claim 1 wherein the stabilizing agent is selected from the group consisting of smectic clay, attapulgite clay, and mixtures thereof.

9. A slurry dishwashing composition comprising a hypohalite bleaching agent selected from the group consisting of alkalimetal and alkaline earth metal hypohalites in a aqueous solution, a silver corrosion inhibiting amount of a silver corrosion inhibitor selected from the group consisting of sulfamic acid and a water soluble salt thereof, said amount being a molar ratio of said inhibitor to said bleaching agent in the range of 1:1 to 3:1, from about 10 percent to about 35 percent by weight builder, from about 0 to about 5 percent by weight surfactant, from about 1 to about 10 percent by weight of a stabilizing agent, and at least 50 percent by weight water and inert filler.

10. A composition of claim 9 wherein the corrosion inhibitor is sulfamic acid.

11. A composition of claim 9 wherein the corrosion inhibitor is a water soluble salt of sulfamic acid.

12. A composition of claim 9 wherein the bleaching agent is sodium hypochlorite.

13. A composition of claim 9 wherein the builder is a polyphosphate.

14. A composition of claim 13 wherein the polyphosphate is sodium tripolyphosphate.

15. A composition of claim 13 wherein the polyphosphate is sodium trimetapolyphosphate.

16. A composition of claim 13 wherein the bleaching agent is a hypochlorite.

17. A composition of claim 16 wherein the hypochlorite is present in the range of from about 0.1 to about 3 percent by weight of the composition.

18. A composition comprising, by weight, from about 3 to about 7 percent sodium carbonate, from about 15 to about 25 percent of a polyphosphate builder, from about 0.1 to about 3 percent of a hypochlorite bleaching agent selected from the group consisting of alkali metal and alkaline earth metal hypohalites, from about 0 to about 5 percent of a surfactant, at least about 50 percent water, a silver corrosion inhibitor selected from the group consisting of sulfamic acid and its water soluble salts in a molar ratio of corrosion inhibitor to bleaching agent of from about 1:1 to about 3:1 and the remainder fillers, thickeners and inert ingredients.

19. A composition of claim 18 wherein the polyphosphate is sodium tripolyphosphate.

20. A composition of claim 19 wherein the bleaching agent is sodium hypochlorite.

21. A composition of claim 20 wherein the corrosion inhibitor is sulfamic acid.

* * * * *